US010378154B2

(12) United States Patent
Luo et al.

(10) Patent No.: US 10,378,154 B2
(45) Date of Patent: Aug. 13, 2019

(54) COMPOSITION FOR USE AS A PAPER STRENGTH AGENT

(71) Applicant: Kemira Oyj, Helsinki (FI)

(72) Inventors: Yuping Luo, Duluth, GA (US); Jiang Li, Johns Creek, GA (US); Thomas J. Lynch, Roswell, GA (US); Jenna Sue Rabideau, Rydal, GA (US); Scott Rosencrance, Douglasville, GA (US)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 15/567,760

(22) PCT Filed: Apr. 19, 2016

(86) PCT No.: PCT/FI2016/050256

§ 371 (c)(1),
(2) Date: Oct. 19, 2017

(87) PCT Pub. No.: WO2016/170230

PCT Pub. Date: Oct. 27, 2016

(65) Prior Publication Data

US 2018/0105988 A1 Apr. 19, 2018

Related U.S. Application Data

(60) Provisional application No. 62/149,940, filed on Apr. 20, 2015.

(51) Int. Cl.

| | |
|---|---|
| ***D21H 21/20*** | (2006.01) |
| ***D21H 17/37*** | (2006.01) |
| ***D21H 21/18*** | (2006.01) |
| ***D21H 17/26*** | (2006.01) |
| ***D21H 17/42*** | (2006.01) |
| ***D21H 17/66*** | (2006.01) |

(52) U.S. Cl.
CPC ..... *D21H 21/20* (2013.01); *D21H 17/26* (2013.01); *D21H 17/37* (2013.01); *D21H 17/42* (2013.01); *D21H 17/66* (2013.01); *D21H 21/18* (2013.01)

(58) Field of Classification Search
USPC ..... 162/164.6
See application file for complete search history.

(56) References Cited

U.S. PATENT DOCUMENTS

2012/0118523 A1 5/2012 Lu et al.

FOREIGN PATENT DOCUMENTS

CN 103469681 A 12/2013
WO 2011/057044 A2 5/2011

*Primary Examiner* — Mark Halpern
(74) *Attorney, Agent, or Firm* — Berggren LLP

(57) ABSTRACT

The present disclosure relates to a method and composition for increasing wet and/or dry strength of a paper product. The method comprises adding a composition comprising at least one polymer having a molecular weight more than 0.5 million Dalton and a degradation agent to a pulp suspension, and forming said paper product.

21 Claims, 6 Drawing Sheets

COMPOSITION FOR USE AS A PAPER STRENGTH AGENT

PRIORITY

This application is a U.S. national application of PCT-application PCT/FI2016/050256 filed on Apr. 19, 2016, claiming priority of U.S. provisional application 62/149,940 filed on Apr. 20, 2015, the contents of all of which are incorporated herein by reference.

FIELD OF THE ART

The present disclosure relates to paper production and, more specifically, to a composition suitable for use in increasing dry and/or strength of a paper product.

BACKGROUND

The papermaking industry continues to be interested in alternative ways to enhance the wet strength of paper products. The continued commercial importance of paper products such as carrier paperboard, tissue and towel drives the quest for improved compositions and methods to enhance the wet strength of paper products.

Polyamidoamide-epichlorohydrin (PAE) resins are commonly used as permanent wet strength agents for manufacturing wet strength paper grades. Typically, the wet strengthened towel grades require high dosage levels of PAE resin to achieve the required wet tensile specifications. The amount of the PAE resin that can be adsorbed onto cellulose fibers is limited by the anionic charge density of the fibers. If not properly managed, unretained wet strength resins will accumulate in the white water system leading to poor machine dewatering, wire and felt filling, sheet breaks and holes, and increased defoamer usage. To overcome these unwanted effects, the system charge is often balanced by applying anionic chemicals such as carboxymethyl cellulose (CMC) and/or anionic synthetic resins.

Carboxymethyl cellulose (CMC) is widely used in production of wet strengthened towel. CMC is reasonably inexpensive when supplied in dry form, either powder or granules. This form requires a makedown system for dissolution prior to use. CMC is prone to biological growth. Another drawback of CMC can be decreased dewatering of the fiber suspension. Both CMC adsorbed to the fiber surfaces and CMC in the liquid phase cause deflocculation of fiber suspension and an increase of the filtration resistance. Thus, the use of CMC can increase the demand for retention aids on paper machines.

Synthetic dry strength resins are often based on polymerization of acrylamide and acrylic acid monomers. The acrylamide-acrylic acid copolymers can be manufactured within a wide range of molecular weight and anionic charge. For instance, these polymers are available as solutions having active polymer solids from 18 to 25%. Solution polymer molecular weight ranges are limited, generally less than 500,000 Dalton, because the bulk viscosity must be low enough to allow the product to be pumpable.

Polyacrylamide dry powder products typically have molecular weight (MW) in the range 10-15 million Dalton. They are cost efficient and easily delivered to remote or oversea customer sites. They are widely used in the treatment of municipal and industrial wastewater.

However, the use of polyacrylamide dry powder products in paper production is not that straightforward. Dry powder products cannot be used as paper dry strength agents because they have a negative effect of overflocculating the sheet due to the extremely high molecular weight these dry polymers carry.

Polyacrylamide products used as paper dry strength agents typically have molecular weight in the range of from 300 000 to 500 000 Dalton. Conventional dry strength agents comprising polyacrylamides are delivered as aqueous solutions that can be further diluted with non-specialized equipment. These conventional dry or wet strength agent solutions usually have about 20% by weight of delivery solids and their target molecular weight is less than 500 000 Dalton due to the bulk viscosity limit for pumping in paper mill applications.

An example of a functional promoter and dry strength resin currently sold to tissue mills is an anionic polyacrylamide product solution with 20% by weight of solids. This aqueous dry strength resin solution is spray dried to produce suitable dispersed powders for those customers who prefer a delivery in dry form. However, a spray drying process is not cost efficient, and significantly increases the manufacturing costs.

There is a need to provide a functional promoter and a dry and/or wet strength agent in a dry powder form which can be efficiently manufactured, transported and regenerated into applicable form suitable for use in a pulp suspension at a paper mill production line.

SUMMARY

In the present disclosure a polymer degradation agent is used to reduce the high molecular weight (MW) of dry polymers to a MW range suitable for paper dry and/or wet strength applications when dissolving the dry powder polymer products in an aqueous solution on site at the paper mills.

The present disclosure provides a method for preparing a product composition comprising polymer dry powder which can be used as a dry and/or wet strength agent in paper processing. Essentially, this composition or blend is obtained by blending a degradation agent with a high molecular weight polymer as a dry powder product. This active composition reacts intrinsically when dissolved in an aqueous solution. In solution the degradation agent reduces the molecular weight of the polymer and decreases the viscosity of the aqueous solution comprising said polymer. Contrary to the expected highly viscous aqueous blend typically obtained without the use of a degradation agent, only a moderately viscous solution is now obtained as a result allowing e.g. pumping.

The first aspect of the present disclosure is a method for enhancing the dry and/or wet strength of a paper product comprising adding a specific composition comprising at least one polymer having a molecular weight of at least 0.5 million Dalton and a degradation agent to a pulp suspension, and forming the paper product from the fibers of the pulp suspension.

The second aspect is the specific composition in a form of a dry premixed blend for increasing wet and/or dry strength of a paper product, comprising polyacrylamide having a molecular weight of more than 1 million Dalton in a form of a dry powder; and a degradation agent also in a form of a dry powder.

The advantages of the present disclosure over conventional material solutions, for example, conventional paper dry or wet strength polymers, and the most common anionic dry strength polymer, carboxy methyl cellulose (CMC), are in that the composition according to the present disclosure achieves desired polymer molecular weight attributes to meet specific paper machine strength and drainage needs by changing the degradation agent content in the blend. Conventional aqueous strength polymers are limited by pumpable bulk viscosity and cannot therefore provide a higher polymer molecular weight range.

In an exemplary embodiment, the composition of for example 2% by weight of dry degradation agent, advantageously ferrous sulfite, and for example 98% by weight of a dry polymer, advantageously polyacrylamide, generated a higher viscosity i.e. molecular weight polymer solution than commercially available solutions, such as anionic PAM solutions, at equal amount of active solids.

Advantageously, the polymer solution made from the blend according to the present disclosure yields better dry strength and wet strength efficiencies, for example about 20% increase, compared to conventional solutions at equal dosage levels. Moreover, this solution is advantageously able to deliver about 90-100% of the performance of CMC.

A further advantage is that the blend of the present disclosure is more easily dissolved in ambient temperature into aqueous solutions than CMC. A sophisticated breakdown system is not required, mere blending tank is sufficient.

Yet, a further advantage is that compared to CMC which gives good dry strength at the expense of drainage, the blend of the present disclosure is able to provide both of these desired properties, the good dry strength and the good stock drainage.

And finally, there is a cost advantage as the cost of the composition of the present disclosure is significantly lower than the cost, for example, of a spray dried polymer products.

DETAILED DESCRIPTION

Figure 1:
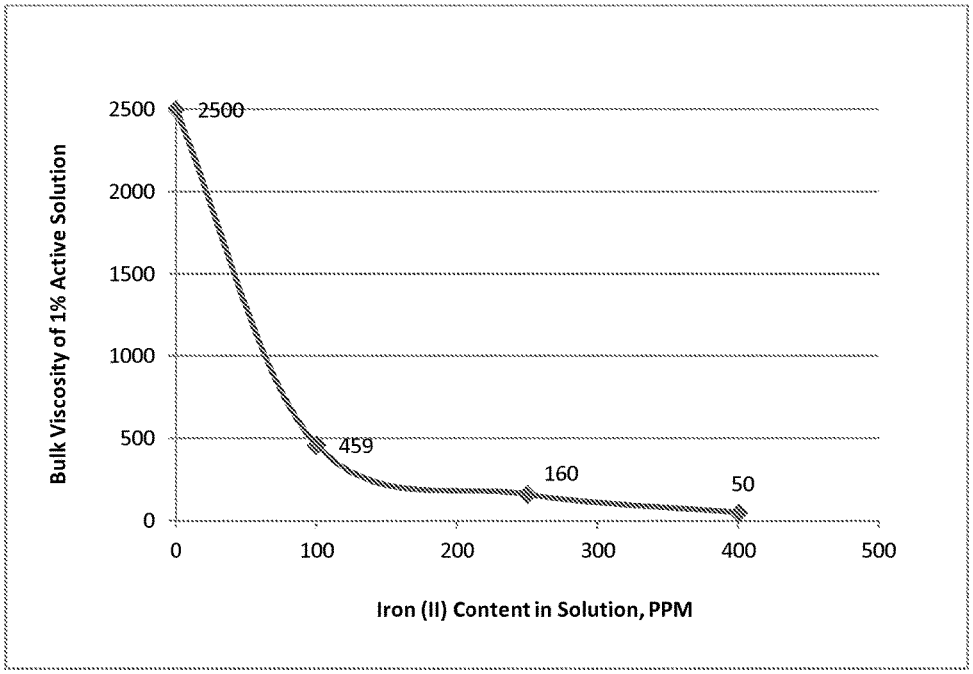
FIG. 1 depicts the effect of ferrous sulfate on viscosity of 1% by weight of polymer solution comprising an anionic polymer.

By the term paper product is meant a web of cellulose fibers. Paper comprises carrier paper and board, tissue papers and towel papers, as well.

By the term dry powder is meant a freely flowing particulate material having a moisture content allowing good flowability.

By the term dry or wet strength is meant a measure of how well a fiber web holds together upon a force of rupture in wet or in dry form. Wet strength is routinely expressed as the ratio of wet to dry tensile force at break. Dry strength or dry tensile strength is the maximum stress that a paper web can withstand while being stretched or pulled before failing or breaking.

By the term viscosity is meant the internal friction or molecular attraction of a given material which manifests itself in resistance to flow. It is measured in liquids by standard test procedures and is usually expressed in poise or centipoise (cP) at a specified temperature. The viscosity of a fluid is an indication of a number of behavior patterns of the liquid at a given temperature including pumping characteristics, rate of flow, wetting properties, and a tendency or capacity to suspend an insoluble particulate material.

As used herein, the terms "polymer," "polymers," "polymeric," and similar terms are used in their ordinary sense as understood by one skilled in the art, and thus may be used herein to refer to or describe a large molecule (or group of such molecules) that contains recurring monomers. Polymers may be formed in various ways, including by polymerizing monomers and/or by chemically modifying one or more recurring monomers of a precursor polymer. A polymer may be a "homopolymer" comprising substantially identical recurring monomers formed by, e.g., polymerizing a particular monomer. A polymer may also be a "copolymer" comprising two or more different recurring monomers formed by, e.g., copolymerizing two or more different monomers, and/or by chemically modifying one or more recurring monomers of a precursor polymer. The term "terpolymer" refers to polymers containing three different recurring monomers. Any of the aforementioned polymers may also be linear, branched or cross-linked. Anionic polymers are polymers carrying a negative netcharge and cationic polymers are polymers carrying a positive netcharge.

In one aspect, the composition of the present disclosure comprises a composition in a form of a dry premixed blend for increasing wet and/or dry strength of a paper product. This composition comprises polyacrylamide having a molecular weight of more than 1 million Dalton and it is in a form of a dry powder. This composition further comprises a degradation agent which is in a form of a dry powder.

As used herein, the term "degradation agent" refers to any compound or mixture of compounds which is capable of degrading a polymer. Preferably, the degradation agent is a compound or mixture of compounds that reduces the viscosity originating from a polymer. More preferably, the degradation agent reduces is a compound or mixture of compounds capable of reducing and con-trolling the molecular weight of a polymer and decreasing the viscosity of an aqueous solution comprising said polymer. Most preferably, the degradation agent reduces the viscosity originating from the anionic polymer used as a dry and/or wet strength agent in paper processing.

In one embodiment the degradation agent is selected from the group consisting of an iron containing compound, persulfate, peroxide, percarbonate, sodium chlorite and tin (II) chloride. Preferably, iron containing compound, persulfate, peroxide or percarbonate, to avoid incorporating chlorides.

In one embodiment, the degradation agent comprises an iron compound. This compound is advantageously a ferrous compound such as a ferrous salt or a ferric compound such as a ferric salt.

The term ferrous is used according to its customary meaning to indicate a diva-lent iron compound (+2 oxidation state or Fe(II)). The term ferric is used according to its customary meaning to indicate a trivalent iron compound (+3 oxidation state or Fe(III)).

In an exemplary embodiment the ferrous salt comprises an organic anion, an inorganic anion, or a mixture thereof. In an advantageous embodiment, the ferrous salt is ferrous citrate, ferrous chloride, ferrous bromide, ferrous fluoride, ferrous sulfate, ammonium iron sulfate or combinations thereof.

In one embodiment, the iron-containing degradation agent comprises ferrous sulfate.

In an exemplary embodiment, the ferric salt comprises an organic anion, an inorganic anion, or a mixture thereof. In exemplary embodiments, the ferric salt is ferric citrate, ferric chloride, ferric bromide, ferric fluoride, ferric sulfate, and combinations thereof.

In an exemplary embodiment, the iron-containing degradation agent is used or combined with other degrading agents, for example ammonium sulfate, ammonium persulfate, enzymes, copper compounds, ethylene glycol, glycol ethers and combinations thereof.

In one embodiment, the degradation agent comprises ferrous sulfate in combination with ammonium persulfate.

The most advantageous polymer degradation agents for polyacrylamide (PAM) polymers include iron compounds, in particular ferrous sulfate, together with persulfates, peroxides, sodium chlorite, tin(II) chloride or percarbonates.

Iron sulfate, in particular ferrous sulfate, is able to dissolve and degrade at ambient pulp suspension conditions whereas the other degradation agents require elevated temperature to achieve the same polymer degradation effectiveness.

In one embodiment according to the present disclosure the amount of degrading agent, in particular ferrous sulfate, is from 1 to 4% by weight of the composition, advantageously from 1 to 3% by weight.

In one embodiment according to the present disclosure the amount of the polymer, in particular polyacrylamide, is at least 95% by weight, in particular 96 to 99% by weight, such as 97 to 99% by weight of the composition.

It was surprisingly found that a dry polymer easily degraded and dissolved into an aqueous solution, such as water, at ambient temperature in the presence of a suitable amount of degradation agent.

In one embodiment the polymer is an anionic or a cationic polymer.

In another embodiment the polymer comprises an acrylamide containing polymer. Advantageously, the polymer is selected from the group consisting of acrylamide homopolymers, copolymers, and terpolymers.

In an exemplary embodiment the polymer is selected from the group consisting of polyacrylamide; polyacrylamide derivatives; methacrylamide homopolymers, copolymers, and terpolymers; diacetone acrylamide polymers; N-methylolacrylamide polymers.

The polymer has advantageously a molecular weight of more than 1 million Dalton, in particular more than 5 million Dalton or even more than 10 million Dalton such as 15 million Dalton.

In one embodiment the anionic dry polymer suitable for use as a dry and/or wet strength agent in paper processing according to the present disclosure is a copolymer comprising acrylamide and acrylic acid, and has advantageously a mole ration of acrylic acid to acrylamide from 0.08 to 0.2, more advantageously from 0.1 to 0.15. Typically, the average standard viscosity of such as solution in aqueous medium is from about 2 to 7 cP.

In an exemplary embodiment, the dry copolymer is most advantageously made of a mole ratio of 10:90 of acrylic acid to acrylamide in order to match the charge efficiency of the commercially available dry strength agents.

The composition to be added comprises advantageously a dry premixed blend of the polymer having a molecular weight more than 0.5 million Dalton and the degradation agent.

The premixed invention blend most advantageously consists of 1-4% ferrous sulfate with 96-99% dry polymer, advantageously polyacrylamide. The degradation of the dry polymer to match the MW range and charge density of commercial products is essential for the disclosure to have commercial value in the towel anionic dry strength market.

In an exemplary embodiment a 1% by weight of polymer aqueous solution was prepared comprising a ratio of 15:85 of acrylic acid to acrylamide dry polymer with addition of 100 ppm ferrous sulfate. This composition yields a bulk viscosity of 280 cP compared to 150 cP of bulk viscosity for a comparative aqueous polymer solution with addition of 600 ppm ferrous sulfate. The polymer solution with addition of 100 ppm ferrous sulfate generates a much higher Mw polymer solution than the polymer solution with addition of 600 ppm ferrous sulfate. The polymer solution with addition of 100 ppm ferrous sulfate content yields a high Mw polymer solution with the Mw range of 1-2 million Dalton, suitable to be used as a dry strength polymer on paper machines. Furthermore, the polymer solution yields better dry strength and wet strength efficiencies, for example about 20% increase at equal dosage levels, compared to the lower Mw polymer solution made of 600 ppm ferrous content. Moreover, it was able to deliver about 120% of the strength performance of the conventional solution dry strength polymer and about 90-100% of the strength performance of CMC. The degradation of anionic dry polymer to different MW range in solution may be controlled by the amount of ferrous sulfate.

In one embodiment according to the present disclosure the polyacrylamide is a cationic polyacrylamide which is a copolymer comprising acrylamide and cationic monomer. Advantageously, the cationic monomers include acryloyloxyethyltrimethyammonium chloride, methacryloyloxyethyl trimethylammonium chloride and dimethylaminoethyl methyacrylate sulfate.

In one embodiment the cationic monomer of the present disclosure is acryloyloxyethyltrimethyammonium chloride which is readily available.

In one embodiment the cationic dry polymer suitable for use according to the present disclosure is a copolymer comprising acrylamide and acryloyloxyethyltrimethyammonium chloride. Advantageously, the mole ratio of acryloyloxyethyltrimethyammonium chloride to acrylamide ranges from 0.05 to 0.30. The average standard viscosity of such a solution in aqueous medium is from about 2 to 7 cP.

In an exemplary embodiment, the blend of the present disclosure consists of 1-5% ferrous sulfate with 95-99% cationic dry polymer. The invention blend dissolved into water at ambient temperature much faster than a comparative aqueous polymer solution without the iron sulfate component.

The degradation of cationic dry polymer to different MW range is controlled by the amount of ferrous sulfate. Degraded aqueous cationic polymer solutions may be used as cationic coagulants or flocculants in paper making wet end system. It is important for the degraded cationic dry polymer to match the MW range of commercial polymer products in order to be able to readily replace the commercially available products without any essential changes in the paper making processing.

In an exemplary embodiment 1% by weight of aqueous polymer solution having the ratio of 15:85 of acrylic acid to acrylamide dry polymer and an added amount of 100 ppm ferrous sulfate yields a bulk viscosity of 280 cP compared to a bulk viscosity of 2500 cP for a comparative aqueous polymer solution without the ferrous sulfate component.

The bulk viscosity of the degradation agent containing solution according to the present disclosure continuously decreases as the degradation agent, in particular ferrous sulfate, content in the aqueous solution increases.

In one embodiment the molecular weight of the anionic or cationic polymer is more than 1 million Dalton, advantageously more than 5 million Dalton or even more advantageously more than 10 million Dalton, such as 15 million Dalton, in a form of a dry powder.

In one embodiment the composition of the present disclosure further comprises a second polymer having a different response to said degradation agent in comparison to said first polymer, especially the first polymer being the anionic polyacrylamide. By forming such blends of polymers the performance in providing dry strength to the resulting product such as paper product may be optimized. Application of multiple polymers such as combinations of anionic and cationic polymers may respond to the degradation at different rates in a way that a unique property or distribution of molecular weights is achieved at any point during or following the degradation.

In an exemplary embodiment a 1% by weight of aqueous polymer solution comprising 50% by weight anionic polyacrylamide dry polymer with 15 mole % charge and 50% by weight 10:90 acryloyloxyethyltrimethyammonium chloride: acrylamide cationic dry polymer together with 400 ppm ferrous sulfate. This amphoteric polymer solution is suitable for use for example in municipal water treatment applications, as well.

In yet another embodiment the composition of the present disclosure further comprises a latent oxidizing agent able to oxidize the degradation agent upon dissolution in an aqueous solution. The oxidizing agent(s) may be packaged or blended directly within the dry polymer composition during or shortly after initial production such that upon dissolution the degradation occurs.

In another aspect, a method for increasing dry and/or wet strength of a paper product is provided. The method comprises adding a composition comprising at least one polymer having a molecular weight more than 0.5 million Dalton and a degradation agent into a pulp suspension, and forming said paper product. Advantageously, the composition is a dry powder which readily dissolves into the pulp suspension.

The anionic polymer has advantageously a molecular weight of more than 1 million Dalton, more than 5 million Dalton or even more than 10 million Dalton such as 15 million Dalton.

In one embodiment of the present disclosure the composition to be added to the pulp suspension is a dry premixed blend of the polymer having a molecular weight more than 0.5 million Dalton and the degradation agent. Depending on the chemical reactiveness of the components a dry premix may be formed and transported to the point of use, premixed at the place of use, or even mixed just prior to addition into the pulp suspension.

In an exemplary embodiment of the present disclosure the composition for increasing the dry and/or wet strength of the formed paper product is added in an amount of up to 2% based on the dry fiber weight of the pulp suspension. The amount to be added is advantageously at least 0.1% by weight, more advantageously at least 0.5% by weight such as 1% by weight. When the concentration is 1% by weight of the suspension the bulk viscosity yielded is about 400 cP.

In one embodiment the composition of the present disclosure is added at ambient temperature of the pulp suspension, advantageously at a temperature less than 45° C., more advantageously from 10 to 40° C., most advantageously from 20 to 30° C. to avoid excess heating or cooling.

In one embodiment the polymer is an acrylamide-containing polymer including acrylamide homopolymers, copolymers, and terpolymers including polyacrylamide; polyacrylamide derivatives; partially hydrolyzed polyacrylamide; partially hydrolysed polyacrylamide derivatives; methacrylamide homopolymers, copolymers, and terpolymers; diacetone acrylamide polymers; N-methylolacrylamide polymers; friction-reducing acrylamide polymers; and combinations thereof. In exemplary embodiments, the acrylamide-containing polymer further comprises any suitable monomers, for example vinyl acetate, N-vinylformamide, N-vinylacetamide, N-vinylcaprolactam, N-vinylimidazole, N-vinylpyridine, 2-acrylamido-2-methylpropanesulfonic acid (AMPS), N-vinylpyrolidone, acrylamidopropyltrimonium chloride, or combinations thereof. Advantageously, the polymer is polyacrylamide.

In one embodiment the polymer is anionic or cationic polyacrylamide.

In one embodiment the composition of the present disclosure comprises a further polymer having a different degradation response to said degradation agent compared to the first polymer.

The degradation agent may be selected from the group consisting of iron containing compound, persulfate, peroxide, sodium chlorite, tin (II) chloride and percarbonate, preferably the degradation agent is iron (II) sulfate. Most advantageously, the degradation agent is ferrous sulfate.

In an exemplary embodiment, the acrylamide-containing polymer is a copolymer.

In an exemplary embodiment, the acrylamide-containing copolymer contains about 1 to about 99, about 5 to about 95, about 10 to about 90, about 20 to about 80, about 30 to about 70, about 40 to about 60 weight percent of acrylamide, methacrylamide or acrylamide derivatives.

In an exemplary embodiment, the acrylamide-containing polymer may have any suitable molecular weight. Advantageously, the acrylamide-containing polymer has a molecular weight of about 1 million Dalton to about 30 million Daltons.

The method of the present disclosure further comprises a step of adjusting the molecular weight of the polymer in the pulp suspension in terms of bulk viscosity by modifying the amount of the degradation agent. The more degradation agent is applied, the more the viscosity or the molecular weight is decreased.

In an exemplary embodiment a 1% by weight aqueous solution of the dry composition containing cationic dry polymer with the ratio of 10:90 of dimethylaminoethyl methyacrylate sulfate to acrylamide together with 1000 ppm ferrous sulfate is prepared. This composition yields a bulk viscosity of 50 cP compared to a bulk viscosity of 400 cP for a comparative aqueous polymer solution with addition of 400 ppm ferrous sulfate. The polymer solution with addition of 1000 ppm ferrous sulfate generates a much lower Mw polymer solution, suitable to be used as a cationic coagulant on paper machines. The polymer solution with addition of 400 ppm ferrous sulfate yielded a high Mw polymer solution with the Mw range of 3-4 million Dalton, suitable to be used as a cationic flocculants on paper machines.

The amount of the degradation agent is advantageously less than 500 ppm, less than 300 ppm, more advantageously less than 150 ppm of the pulp suspension.

In a further embodiment the composition of the present disclosure is used in mineral processing for aiding in dewatering. As such a dewatering aid would subsequently provide dispersion stability or other suitable secondary attributes.

In summary, the compositions according to the present disclosure offer the following advantages:

Anionic charge comparable with conventional anionic PAM.

Dry strength efficiency comparable with CMC at equal dosage levels.

Improved stock drainage over CMC.

The compositions according to the present disclosure further offer improved wet end operational charge control, strength performance, and drainage. The benefits offered by the compositions further include:

Improved wet strength resin machine retention.

More effectively optimized wet end charge compared to conventional aqueous anionic polymers.

Enhanced ability for paper machines to load wet strength resins to achieve sheet strength targets.

Reduction or elimination of CMC in high wet strengthened towel grades.

The present disclosure is further illustrated by the following non-limiting examples.

EXAMPLES

Example 1

An anionic dry polymer (Superfloc A110, from Kemira Oyj) having a molecular weight range of 10 to 15 million Dalton was easily degraded and dissolved into water at ambient water temperature of about 25° C. The dissolution time for the polymer was about 1-2 h. A 1% by weight aqueous solution was prepared and iron (II) sulfate was added thereto. The iron sulfate amounts were 0, 100, 250 and 400 ppm.

FIG. 1 shows that the bulk viscosity of the solution decreased as the content of the iron (II) sulfate in the water increased. Desired polymer molecular weight attributes could be achieved to meet the specific paper machine strength and drainage needs by changing the iron (II) content in the blend.

The initial bulk viscosity was about 2500 rapidly decreasing to about 459 with the addition of 100 ppm. Subsequent additions decreased the viscosity further into about 50 @ 400 ppm addition.

Example 2

The molecular weight of a solution according to the present disclosure having 1% by weight of anionic acrylamide polymer (Superfloc A110) and 100 ppm iron (II) sulfate was prepared and compared with solutions consisting of commercial products anionic acrylamide polymer (Superfloc A110), Fennobond 85 and CMC.

TABLE 1

| product | bulk viscosity of 1% by weight solution, cP | standard viscosity, cP | anionic charge density meq/dry g |
|---|---|---|---|
| Superfloc A110 | 2500 | 4.9 | 10 mol-% acrylic acid |
| Fennobond 85 | 8.9 | 1.33 | −1.25 |
| CMC | 3.7 | n/a | −3.02 |
| present disclosure | 50 | 1.65 | −1.76 |

It can be seen from table 1 that the use of a composition of the present disclosure yielded a higher bulk solution viscosity and standard viscosity than commercial Fennobond 85 product. This indicates a higher polymer MW that in Fennobond 85. The charge density of the product according to the present disclosure has a higher charge density than Fennobond 85. It would more effectively optimize the wet end charge, as well.

Example 3

CMC and anionic synthetic dry strength resins are often used on wet strengthened towel machines to optimize the wet end charge and to develop paper dry strength.

Figure 2:
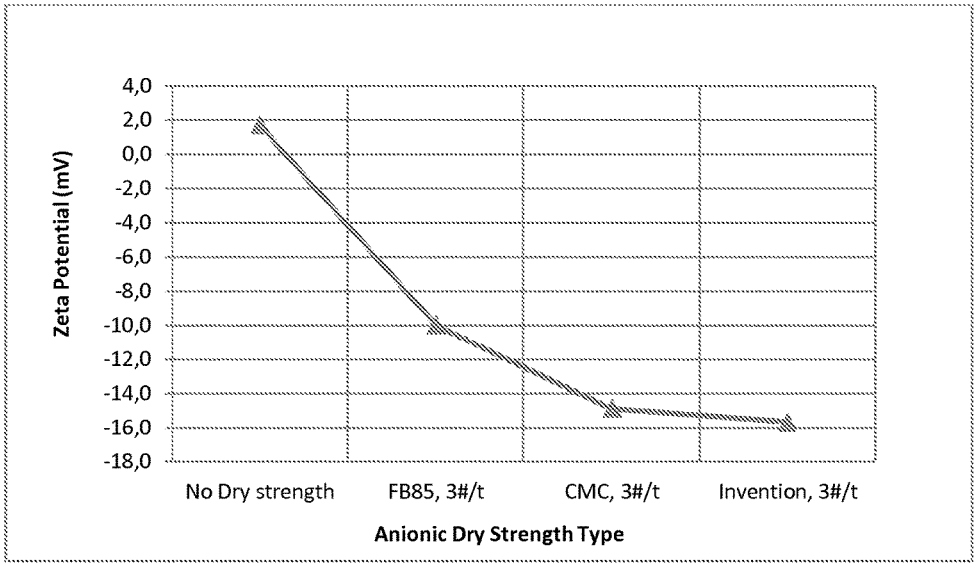
FIG. 2 depicts the headbox zeta values of a stock whereto 5.9 kg/t polyacrylamide epichlorohydrine (PAE) resin is added together with an anionic dry strength composition.
Figure 3:
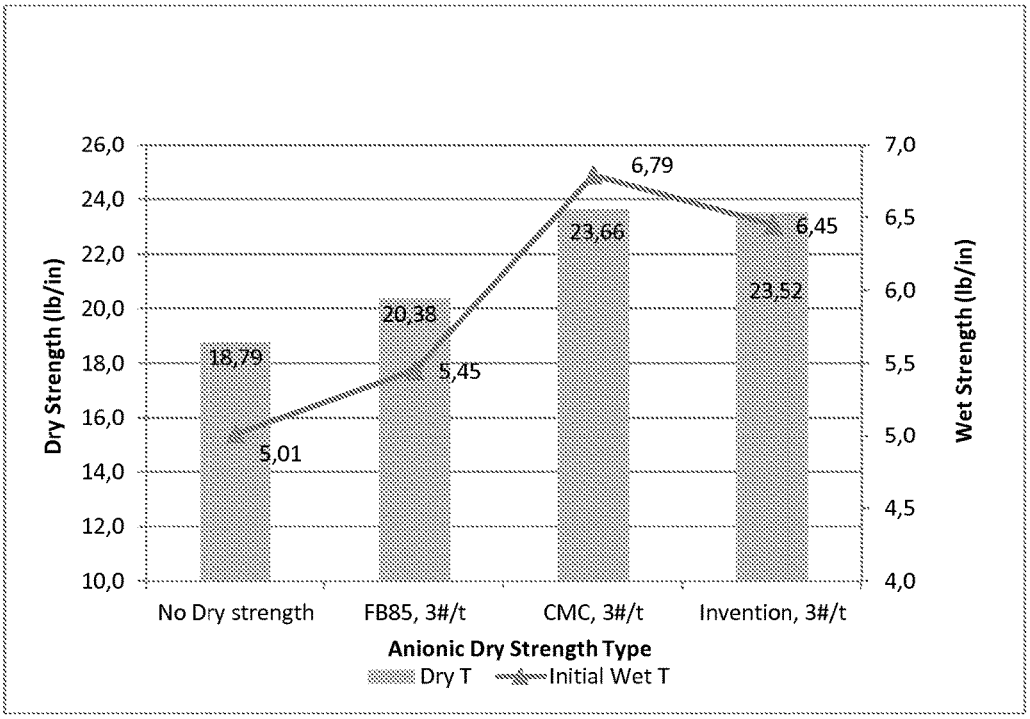
FIG. 3 depicts the effect of anionic dry strength compositions on PAE wet strengthened handsheet wet and dry strengths.

Hand sheets were prepared using a standard hand sheet method. Three different dry strength compositions were used for these experiments together with 5.9 kg/t polyamide amine epichlorohydrine (PAE) resin and the results thereof were compared to each other:

One composition was according to the present disclosure (invention), namely 1% of Superfloc A110 with 100 ppm iron (II) sulfate (notation "invention 3/t" in FIGS. 2 and 3).

One composition was commercially available Fennobond 85 solution (notation "FB85 3/t" in FIGS. 2 and 3).

One composition was carboxymethyl cellulose (CMC) solution (notation "CMC 3/t" in FIGS. 2 and 3).

As depicted by FIG. 2 composition of the present disclosure was able to optimize the wet end charge clearly more effectively than the comparative composition comprising Fennobond 85. The results when using the composition of the present disclosure seems to provide a very similar impact on the wet end charge as the comparative composition comprising CMC.

As depicted by FIG. 3 the composition of the present disclosure yielded better dry strength and wet strength efficiencies than the comparative composition comprising Fennobond 85 at equal dosage levels. The enhancement is about 20%. Compared to the performance of the comparative composition comprising CMC the result is about equal (95-100%). Moreover, it should be notified that even if the comparative composition comprising CMC gives good dry strength the drainage is quite poor. Whereas the composition of the present disclosure gives both good dry strength and good stock drainage.

Comparative Example 4

Synthetic dry strength resins are often based on copolymerization of acrylamide and acrylic acid monomers. The acrylamide-acrylic acid copolymers are adjustable and can be manufactured with a range of molecular weights and anionic charge. These polymers are usually available as solutions ranging from 18 to 25% solids.

Figure 4:
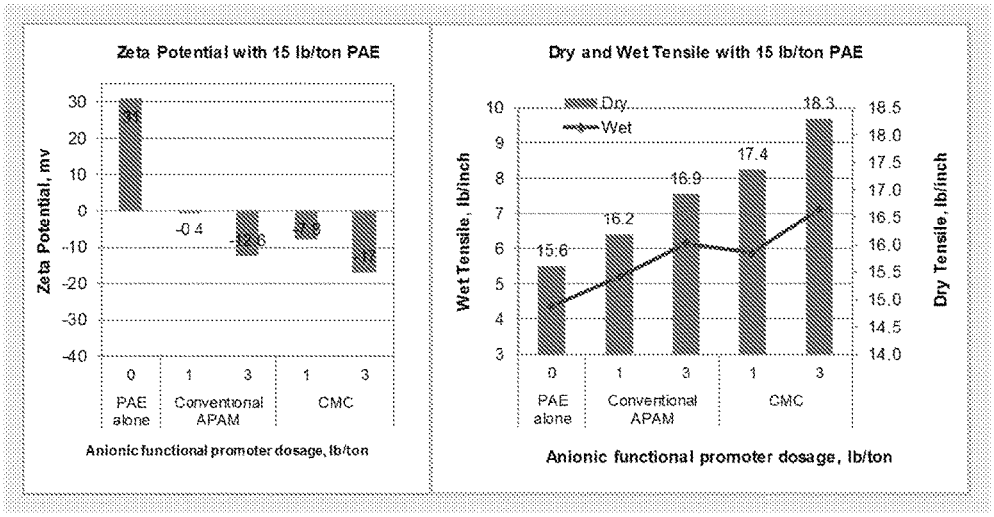
FIG. 4 depicts the effect of conventional APAM vs. CMC on fiber zeta potential and strength of bleached virgin stock.

FIG. 4 demonstrates that addition of 6.8 kg/ton (15 lb/ton) PAE resin can cause the wet end charge of bleached virgin stock to become cationic which in turn limits sheet wet tensile development. To overcome this limitation often anionic polyacrylamide (APAM) and/or CMC is added to maintain the charge in the anionic region. This addition results in a wet tensile increase. In this example, CMC increases sheet dry tensile strength by about 8% and the wet tensile by 14%.

FIG. 4 depicts the effect of conventional APAM vs. CMC on fiber zeta potential and strength of bleached virgin stock.

Example 5

The compositions according to the present invention were used in a combination with a PAE wet strength resin and result in increased wet and dry strength efficiencies.

Figure 5:
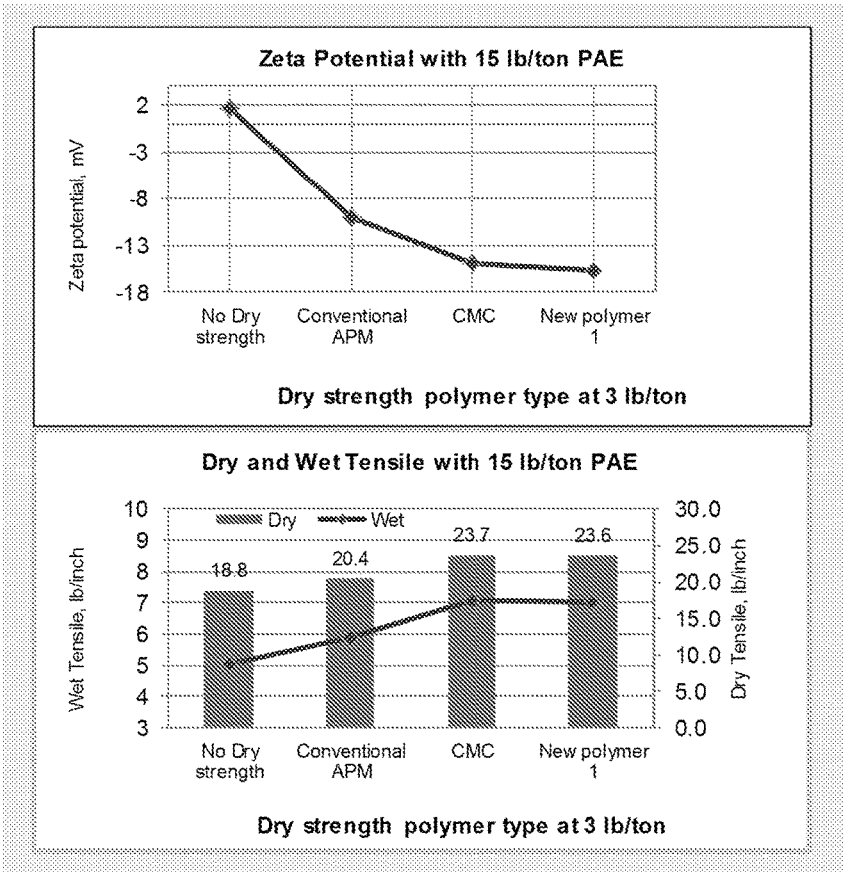
FIG. 5 depicts a comparison of the new polymer 1 vs. conventional APAM and CMC on fiber zeta potential and strength of bleached virgin stock.

FIG. 5 shows that the a composition according to the present invention (notation in FIG. 5 "new polymer 1") containing Superfloc A110 and 400 ppm of Fe(II)SO4, having standard viscosity of 1.65 cP optimizes the wet end charge more effectively than the conventional anionic PAM and yields the same impact on the wet end charge as CMC at equal dosage levels. The new polymer 1 is capable of delivering the same performance as CMC.

FIG. 5 depicts a comparison of the new polymer 1 vs. conventional APAM and CMC on fiber zeta potential and strength of bleached virgin stock.

Example 6

Figure 6:
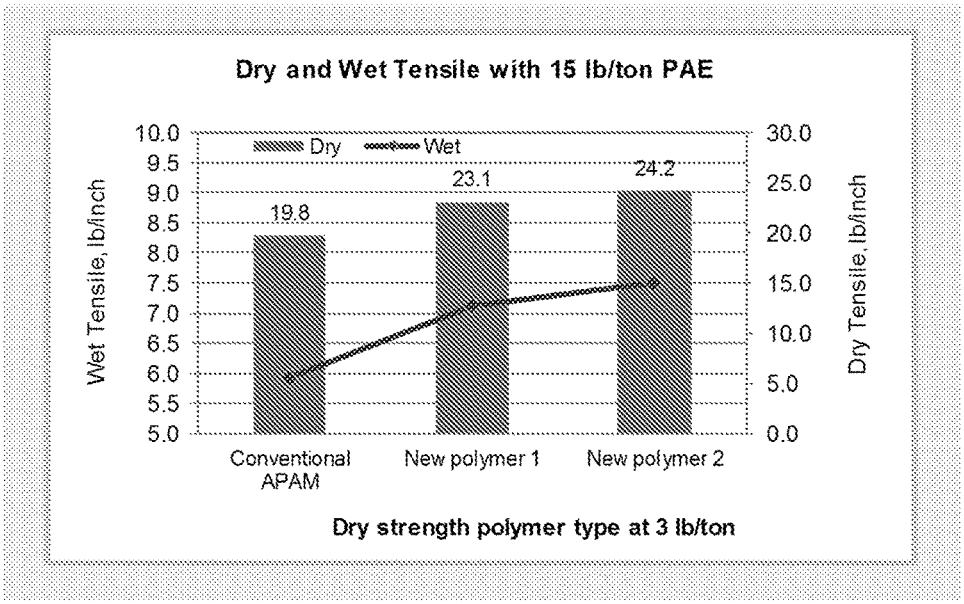
FIG. 6 depicts the sheet strength efficiencies as a function of the polymer choice.

FIG. 6 shows how the polymer choice affects the zeta potential and tensile strength development. The composition according to the present invention (notation "New Polymer 2" in FIG. 6) containing Superfloc A110 and 250 ppm of Fe(II)SO4, having standard viscosity of 192 cP optimizes the wet end charge more effectively and eventually results in greater wet and dry strength development.

FIG. 6 depicts the sheet strength efficiencies (line=wet strength and bars=dry strength) as a function of the polymer choice.

Example 7

Figure 7:
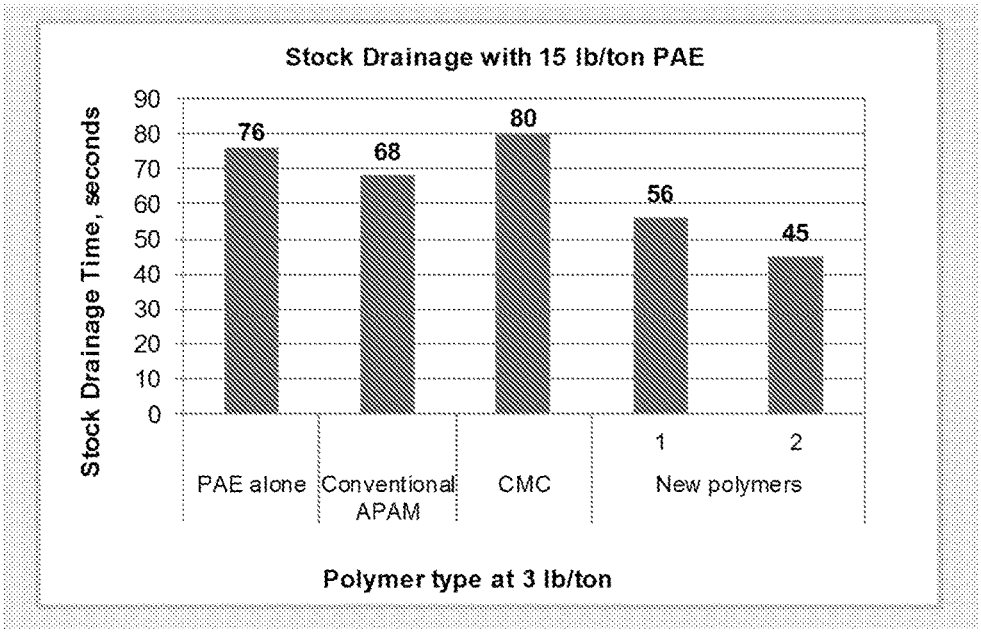
FIG. 7 depicts the effect of polymers vs. CMC on stock drainage rates of low freeness (358 CSF) OCC stock.

CMC has been used to efficiently enhance wet and dry strength of paper. Besides these positive effects, CMC may affect the fines retention and stock dewatering processes negatively. FIG. 7 shows differences in the OCC stock drainage time based on a free stock drainage test. These negative effects are mainly seen when fiber stock is treated with high CMC dosages. Results of the dewatering experiments showed that CMC modification fiber stock increased the drainage time due to a denser and more plugged sheet. The compositions according to the invention used in examples 5 and 6 (notation in FIG. 7 "New Polymers") provide both good strength efficiencies and stock drainage rates.

FIG. 7 depicts the effect of polymers vs. CMC on stock drainage rates of low freeness (358 CSF) OCC stock.

Unlike conventional APAM resins with molecular weight limits for pumpable bulk viscosity, the new polymers offer various molecular weight grades to meet specific paper machine strength and drainage needs. By selecting the correct combination of polymer molecular weight and charge, the new polymers have positively demonstrated the ability to be more cost-effective than conventional APAM resins.

Example 8

A major tissue producer manufactures an unbleached folding towel using 100% recycled fibers. Wet and dry tensile are critical targets. They are using the combination of PAE and CMC to control wet and dry tensile. The machine is experiencing frustration with the CMC related wet end deposit as well as poor stock drainage. As a result, the mill decides to reduce or eliminate use of CMC.

The new polymer 2 as in example 6 was evaluated to reduce or eliminate CMC use on this machine. The mill control condition uses PAE resin (11.3 kg/ton; 25 lb/ton) with CMC at a dosage of 2.7 kg/ton (6 lb/ton) at a papermaking pH of 7.5.

Figure 8:
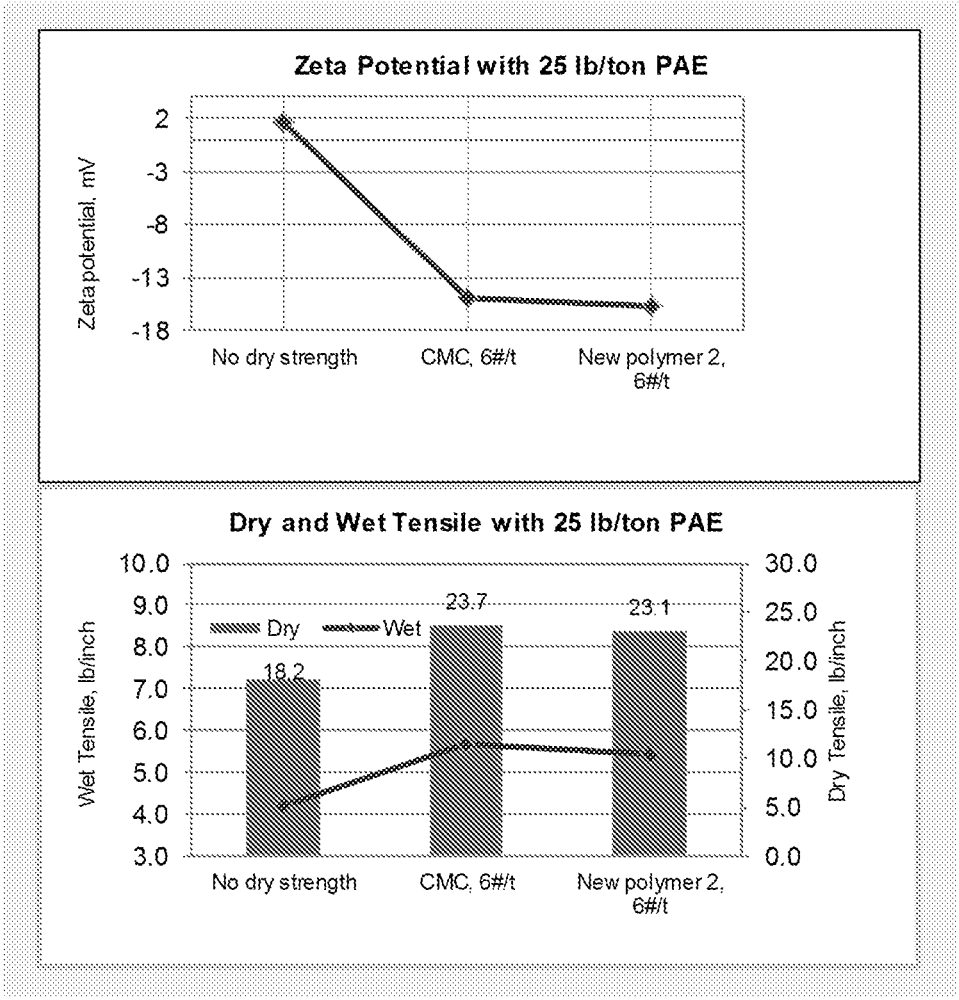
FIG. 8 depicts replacing CMC with the New Polymer 2 on headbox charge (zeta potential) and sheet strengths of 100% recycled unbleached folding towel sheets.

The zeta potential of the fiber surface after the new polymer addition is shown in FIG. 8 (line).

The new polymer 2 optimizes the wet end charge effectively and yields the same impact on the wet end charge as CMC at equal dosage levels. The new polymer delivers sheet strength efficiencies which are comparable with CMC, shown in FIG. 8 (bars).

Figure 9:
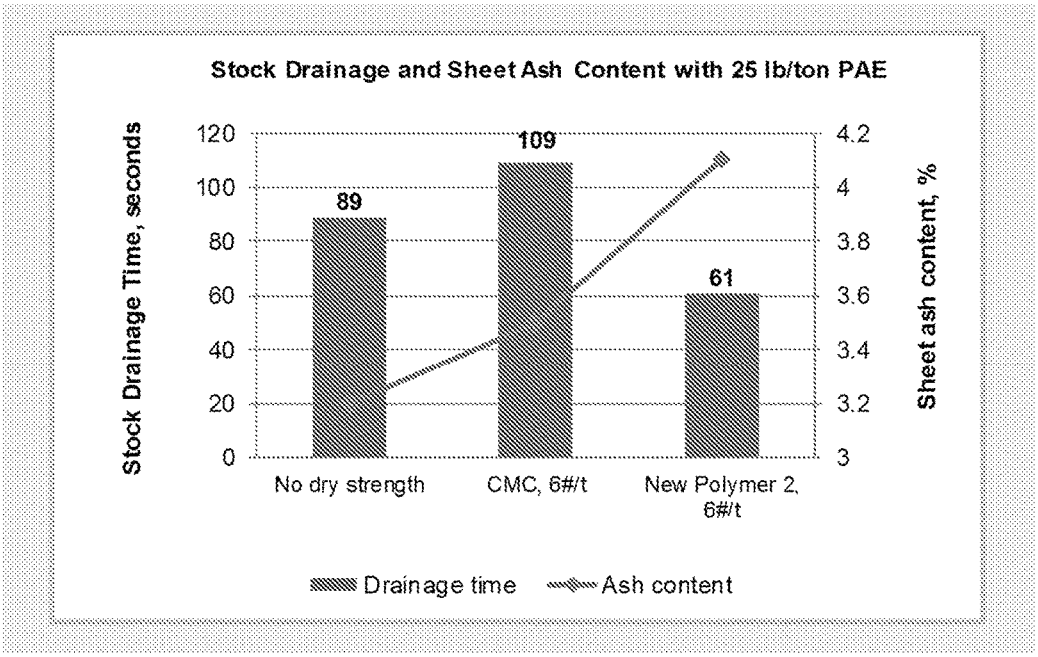
FIG. 9 depicts replacing CMC with the New polymer 2, resulting in an increase in stock drainage rate and sheet ash content.

However, CMC provides good sheet strengths at the expense of poor stock drainage and less effectively removing ash from the process. FIG. 9 summarizes the stock drainage trial results (bars) and sheet ash content (line). The low freeness 100% recycled stock drainage time increases with CMC addition. The new polymers positively affect the stock drainage rates and increases sheet ash content over the CMC treatment condition, shown in FIG. 9.

The recycled furnish ash content can play a significant role in machine operating efficiency and sheet strength quality. If not removed through the washing and cleaning process, ash can accumulate up to levels of 30% or higher in the headbox, forming sticky agglomerates and deposits. The New Polymers can fix ash to the sheet and more effectively remove ash from the process. This study demonstrates that the new polymer can replace CMC and provides both good sheet strength and stock drainage improvement.

FIG. 8 depicts replacing CMC with the New Polymer 2 on headbox charge (zeta potential) and sheet strengths of 100% recycled unbleached folding towel sheets.

FIG. 9 depicts replacing CMC with the New polymer 2, resulting in an increase in stock drainage rate and sheet ash content.

The invention claimed is:

1. A method for increasing dry and/or wet strength of a paper product, comprising:

adding a composition comprising at least one polymer having a molecular weight more than 0.5 million Dalton and a degradation agent to a pulp suspension, and forming said paper product.

2. The method of claim 1, wherein the composition to be added is a dry premixed blend of the polymer having a molecular weight more than 0.5 million Dalton and the degradation agent.

3. The method of claim 1, wherein the composition is added in an amount of up to 2% by weight based on the dry fiber weight of the suspension.

4. The method of claim 1, wherein the composition is added at ambient temperature of the pulp suspension, at a temperature less than 45° C.

5. The method of claim 4, wherein the composition is added at ambient temperature of the pulp suspension, from 10 to 40° C.

6. The method of claim 4, wherein the composition is added at ambient temperature of the pulp suspension, from 20 to 30° C.

7. The method of claim 1, wherein the polymer is anionic or cationic polymer.

8. The method of claim 7, wherein the polymer is an acrylamide containing polymer.

9. The method of claim 8, wherein the polymer is selected from the group consisting of acrylamide homopolymers, copolymers, and terpolymers.

10. The method of claim 9, wherein the polymer is selected from the group consisting of polyacrylamide; polyacrylamide derivatives; methacrylamide homopolymers, copolymers, and terpolymers; diacetone acrylamide polymers; N-methylolacrylamide polymers.

11. The method of claim 10, wherein the polyacrylamide comprising acrylamide and acrylic acid and has a mole ratio of acrylic acid to acrylamide from 0.08 to 0.15.

12. The method of claim 11, wherein the polyacrylamide comprising acrylamide and acrylic acid and has a mole ratio of acrylic acid to acrylamide from 0.1 to 0.2.

13. The method of claim 1, wherein the composition comprises a further second polymer having a different degradation response to said degradation agent compared to the first polymer.

14. The method of claim 1, wherein the degradation agent is selected from the group consisting of iron containing compound, peroxide, sodium chlorite, tin (II) chloride, percarbonate and ferrous sulfate.

15. The method of claim 1, wherein said method further comprises a step of adjusting the molecular weight of the polymer in the pulp suspension in terms of bulk viscosity by modifying the amount of the degradation agent present.

16. The method of claim 1, wherein the amount of the degradation agent is less than 500 ppm of the pulp suspension.

17. A composition in a form of a dry premixed blend for increasing wet and/or dry strength of a paper product, comprising:

polyacrylamide having a molecular weight of more than 1 million Dalton in a form of a dry powder; and a degradation agent in a form of a dry powder.

18. The composition of claim 17, wherein the degradation agent comprises ferrous sulfate.

19. The composition of claim 17, wherein the amount of polyacrylamide is more than 95% by weight or 96 to 99% by weight and/or the amount of degradation agent is from 1 to 5% by weight or 1 to 4% by weight.

20. The composition of claim 17, wherein the polyacrylamide is a copolymer comprising acrylamide and acrylic acid, or a copolymer comprising acrylamide and acrylic acid having a mole ratio of acrylic acid to acrylamide from 0.08 to 0.15, or from 0.1 to 0.2.

21. The composition of claim 17, wherein said composition further comprises a polymer having a different response to said degradation agent in comparison to said polyacrylamide and/or said composition further comprises a latent oxidizing agent able to oxidize the degradation agent upon dissolution in an aqueous solution.

* * * * *